US005608979A

United States Patent [19]

Johnson

[11] Patent Number: 5,608,979

[45] Date of Patent: Mar. 11, 1997

[54] MULTI-MESSAGE SIGN

[76] Inventor: Michael V. Johnson, 1602 SW. 2nd St., Bentonville, Ark. 72712

[21] Appl. No.: 261,737

[22] Filed: Jun. 17, 1994

[51] Int. Cl.[6] ..... G09F 11/30

[52] U.S. Cl. ..... 40/491; 40/601

[58] Field of Search ..... 40/489, 490, 491, 40/601, 617; 292/11, 12, 45, 220; 116/215

[56] References Cited

U.S. PATENT DOCUMENTS

| | | | |
|---|---|---|---|
| 627,396 | 6/1899 | Daly | 40/491 X |
| 1,595,734 | 8/1926 | Scherer | 116/215 |
| 2,536,645 | 1/1951 | Johnson et al. | 40/490 |
| 3,229,903 | 1/1966 | Smith | 116/215 X |
| 3,586,320 | 6/1971 | Mace | 116/215 X |
| 3,866,343 | 2/1975 | Frost et al. . | |
| 3,991,495 | 11/1976 | Wilson . | |
| 4,005,536 | 2/1977 | Fanning, Jr. . | |
| 4,040,382 | 8/1977 | Sheppard | 116/215 X |
| 4,217,713 | 8/1980 | Greenberger | 40/488 |
| 4,270,291 | 6/1981 | Babberl | 40/594 |
| 4,277,239 | 7/1981 | Genis . | |
| 4,404,764 | 9/1983 | Wills et al. | 40/124.1 |
| 4,461,107 | 7/1984 | Grate | 40/576 |
| 4,616,861 | 10/1986 | Kurosaki | 292/45 X |
| 4,780,978 | 11/1988 | Sonderbaek | 40/584 |
| 4,884,352 | 12/1989 | Lipscomb | 40/611 |

FOREIGN PATENT DOCUMENTS

| | | | |
|---|---|---|---|
| 369597 | 1/1907 | France | 40/490 |

*Primary Examiner*—Joanne Silbermann
*Attorney, Agent, or Firm*—Boyd D. Cox

[57] ABSTRACT

A multi-message sign includes a frame having a recessed front panel adapted to releasably mount a primary sign by use of double-stick tape or other suitable fasteners. A plurality of additional secondary signs disposed in overlying relation within the frame selectively drop through a slot in a bottom portion of the frame for display. The primary and secondary signs each preferably include indicia for sighted persons and corresponding braille indicia for blind persons. The inventive sign includes a hidden pivotal release mechanism operated by insertion of a coin into a slot to release and drop the secondary signs. The sign includes several decoy slots to deter tampering. In order to facilitate convenient change of the secondary signs while deterring tampering, the frame includes a bottom cover detachably secured by concealed latch members.

30 Claims, 6 Drawing Sheets

MULTI-MESSAGE SIGN

BACKGROUND OF THE INVENTION

The present invention relates to signs, and more particularly pertains to an improved sign which allows selective display of a plurality of different signs disposed within a common frame.

Signs are common in the workplace and in the public arena and serve many purposes. Signs provide information, instruction, guidance, warning, and notice of changes. Generally, where there is one sign, another is needed. People become accustomed to the location, size, color, and shapes of various signs. When there is a variance in the abovementioned factors, the message can become confusing, or even lost. Additionally, signs also provide the aforementioned benefits to the disabled. With this in mind, the Americans With Disabilities Act was enacted and became effective in July, 1993. Heretofore, most signs were typically designed only for sighted persons, and did not incorporate readily accessible braille messages for the blind.

Also, typical signs have not allowed users and manufacturers to readily install additional messages or to change existing messages. For example, a typical sign might display the message "ENTER" to designate a door or entry. However, additional messages such as "CAUTION WET FLOOR" or "ONLY WITH RESPIRATOR" or "USE OTHER DOOR" might also be needed, at least during certain time periods. Since the original sign did not include facilities for display of such additional messages, and since the user can not conveniently provide the needed signage, the needed secondary message is never given or not given in a timely manner in the event a sign or warning device must be retrieved from a remote storage location. In the absence of such additional messages, a person, particularly an injured or disabled person, might be subjected to a dangerous situation.

Clearly, the chance that such needed or desired additional messages will be displayed would be increased if a sign including a plurality of selectively and conveniently displayable messages were available. However, signs with a plurality of removable components are subject to damage from vandals, the curious, or children, such that the messages might be removed.

A wide number of standard signs are available on the market, many of which meet A.D.A. standards. Typical standard sign sizes are 8 inch by 8 inch square or 6 inch by 9 inch rectangular. A multi-message sign designed to accommodate such conventional standard signs would allow users and manufacturers to readily select a wide variety of different messages for display.

SUMMARY OF THE INVENTION

The present invention provides an improved sign which includes a frame including a recessed front panel adapted to releasably mount a primary sign by use of double-stick tape or other suitable fasteners. A plurality of additional secondary signs disposed in overlying relation within the frame selectively drop through a slot in a bottom portion of the frame for display. The primary and secondary signs each preferably include indicia for sighted persons and corresponding braille indicia for blind persons. The inventive sign includes a hidden pivotal release mechanism operated by insertion of a coin into a slot to release and drop the secondary signs. The sign includes several decoy slots to deter tampering. In order to facilitate convenient change of the secondary signs while deterring tampering, the frame includes a bottom cover detachably secured by concealed latch members.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
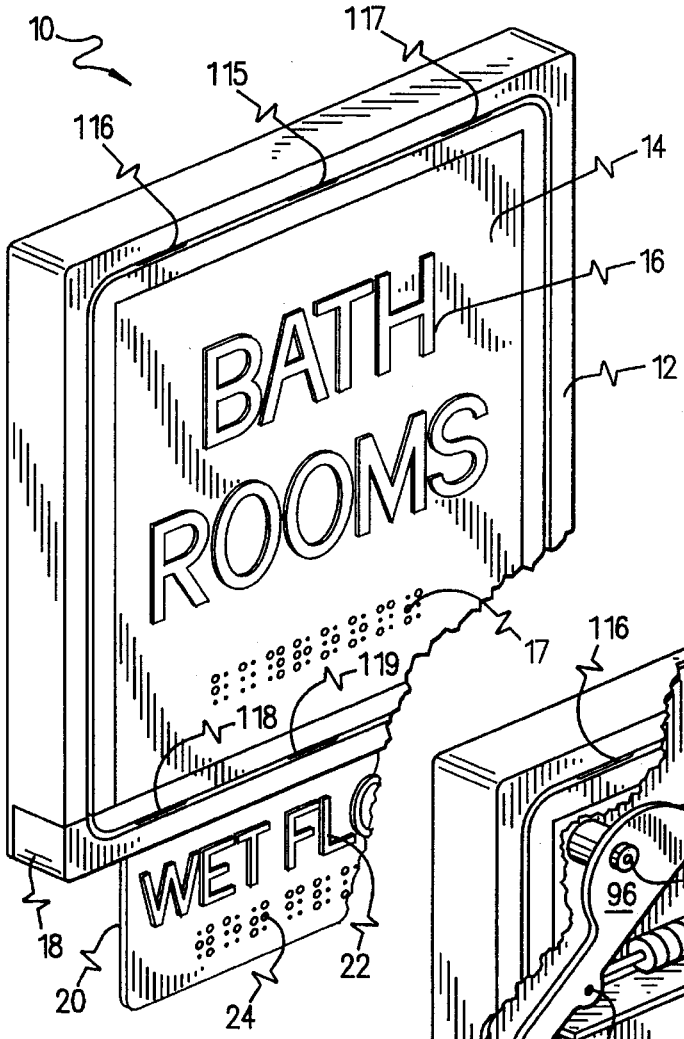
FIG. 1 is a partial perspective view of the multi-message sign according to the present invention.
Figure 8:
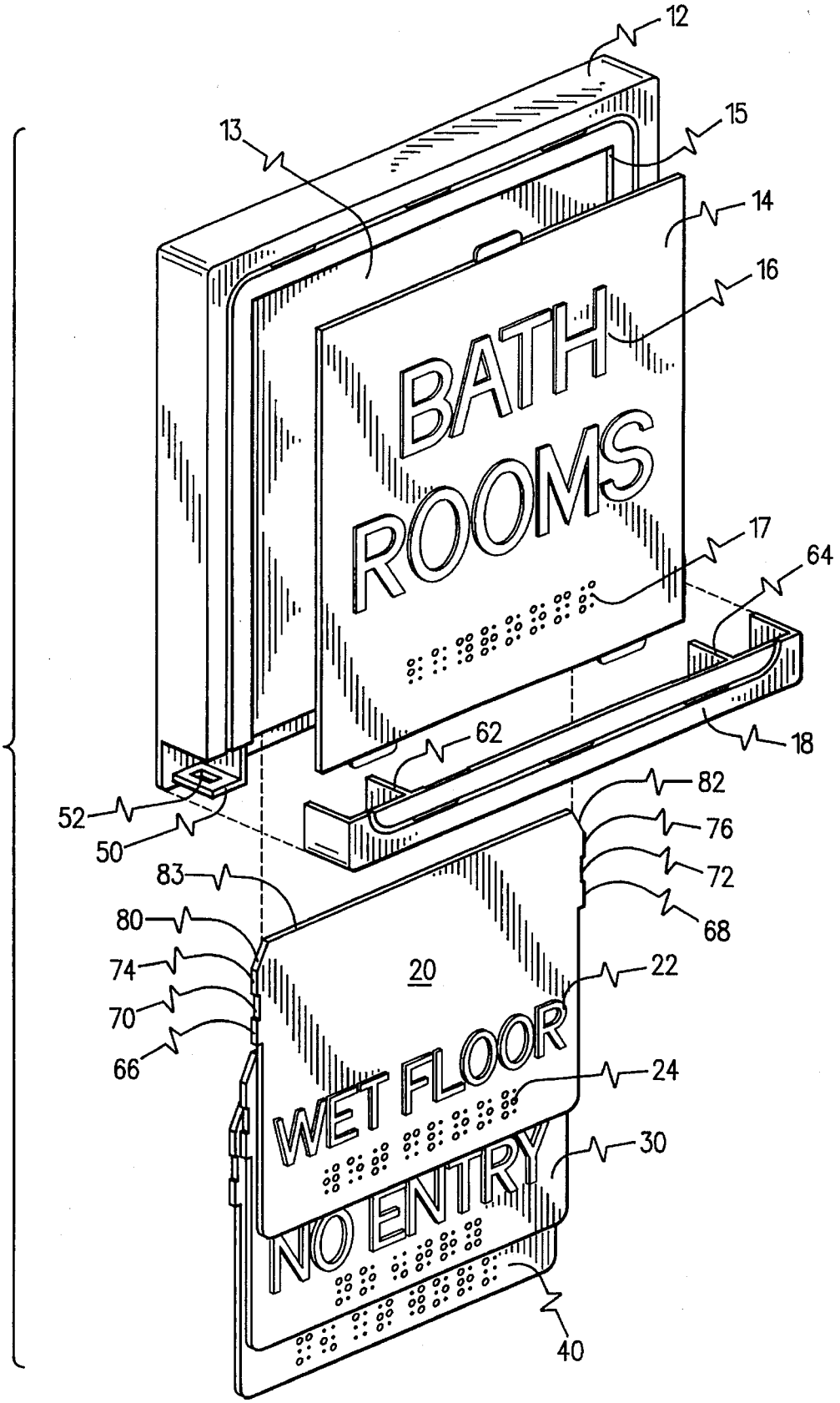
FIG. 8 is a partially exploded perspective view illustrating primary and secondary sign components of the multi-message sign of the present invention.

Referring now to the drawings, wherein like reference numerals designate corresponding structure throughout the views, and referring in particular to FIGS. 1 and 8, an improved multi-message sign 10 according to an example preferred embodiment of the invention includes a frame 12 having a front panel 13 forming a square or rectangular region 15 recessed inwardly relative to peripheral edge portions of the frame 12. A primary sign 14, including first lettering indicia 16 for conveying a message to sighted individuals and second braille indicia 17 for use by blind individuals, may be detachably mounted within the recessed region 15 by a variety of fastening techniques such as double sided tape, adhesives, mating tabs and slots, etc. Advantageously, the recessed region 15 is dimensioned to receive a standard 8 by 8 inch or 6 by 9 inch sign, such that the sign 10 may be mounted in place of an existing conventional sign which then becomes the primary sign 14. A removable cover 18 selectively detachable from a bottom front region of the frame 12 allows selective removal and replacement of a plurality of secondary signs 20, 30, and 40. Each of the secondary signs also preferably includes first and second indicia for use by sighted and blind persons, respectively. For example, secondary sign 20 includes first indicia 22 for use by sighted individuals and second indicia 24 for use by blind persons. The primary 14 and secondary 20, 30, and 40 signs may be formed in a variety of different ways. For example, the signs may take the form of backing plates to which removable indicia is applied. For example, the indicia might comprise an adhesive tape upon which desired indicia is imprinted. Conventional devices are available for imprinting braille indicia on such adhesive tape. The signs might also be dimensioned as backing plates to which conventional standard sized signs may be secured. Alternatively, the primary and secondary signs might take the form of integral signs bearing indicia printed, painted, molded, or otherwise directly applied by the manufacturer. Additionally, the primary and secondary signs may have different messages printed on the fronts and backs thereof, thereby providing additional communication choices to the user of the multi-message sign 10. In any event, a wide variety of different techniques may be employed in the formation of the primary and secondary signs without departing from the scope of the present invention.

Figure 9:
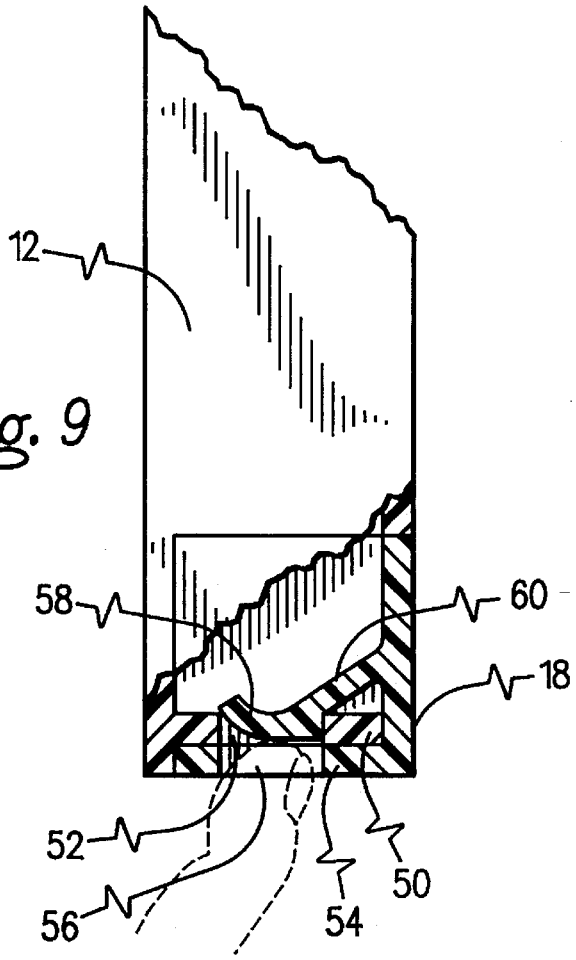
FIG. 9 is a partially cut-away cross-sectional detail view illustrating a latch member for securing a detachable cover of the multi-message sign of the present invention.
Figure 10:
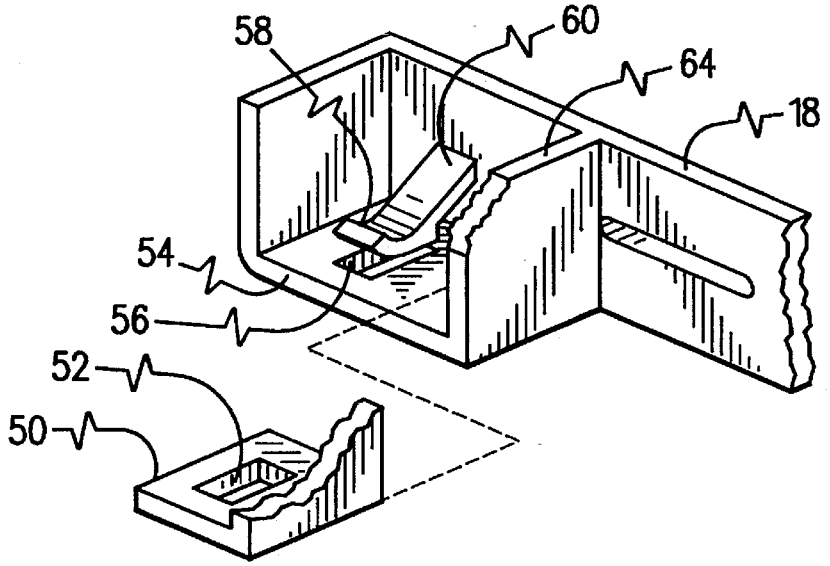
FIG. 10 is an exploded perspective detail view further illustrating the latch member for securing the cover of the multi-message sign of the present invention.

With reference to FIGS. 8–10, the cover 18 includes concealed latch members 58 at opposite ends which cooperate with flange portions 50 on opposite bottom side portions of the frame 12 to detachably secure the cover 18 in place. Specifically, opposite end regions of the cover 18 each include a resilient latch member 58 connected to the cover 18 by an integrally molded live hinge 60. In use, the flange 50 of the frame 12 slips between the latch member 58 and a cover floor portion 54, causing the latch member 58 to click into engagement with a flange aperture 52. In order to remove the cover, an individual inserts a finger into an aperture 56 in the cover floor 54 and pushes the latch member 58 upwardly, out of engagement with the flange aperture 52, while simultaneously pulling the cover 18 outwardly away from the frame 12.

Figure 7:
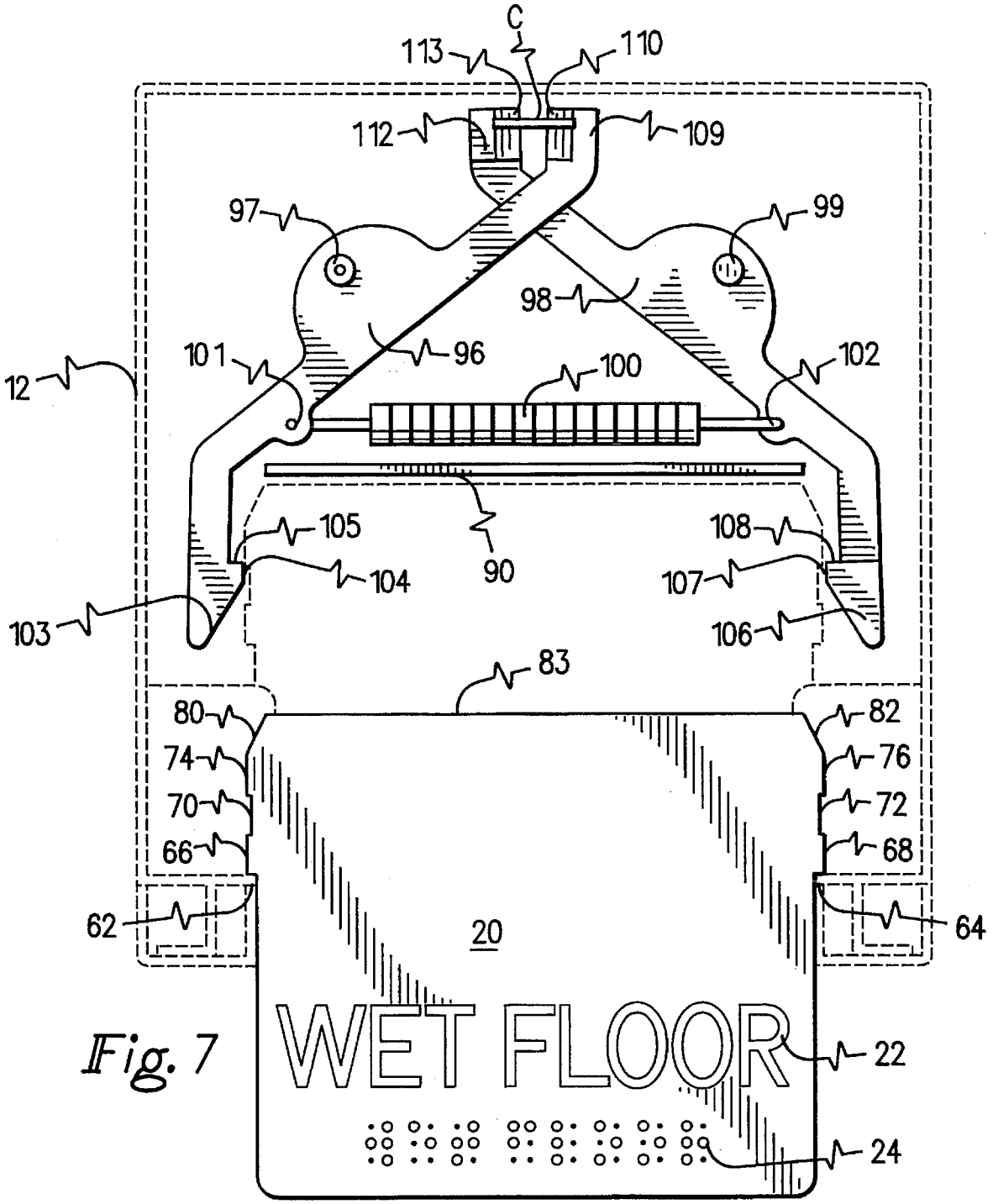
FIG. 7 is a diagrammatic front elevational view illustrating the manner of operating the secondary sign retaining mechanism of the multi-message sign of the present invention.

Removal of the cover 18 allows removal and replacement of the secondary signs 20, 30, and 40, because the cover 18 serves to retain the secondary signs at least partially within the frame 12. With reference to FIGS. 7 and 8, each of the secondary signs, for example the secondary sign 20, include juxtaposed laterally projecting tab portions 66 and 68 which abut with top surfaces of transverse cover wall portions 62 and 64, thus retaining the secondary signs from falling out of an open central bottom portion of the cover 18 extending between the wall portions 62 and 64. Opposite vertical side edges of the secondary signs are symmetrical, and include aligned notches 70 and 72 connected by respective straight edge portions 74 and 76 to inclined corner facets 80 and 82. A straight top edge 83 of each secondary sign connects the corner facets 80 and 82.

Figure 2:
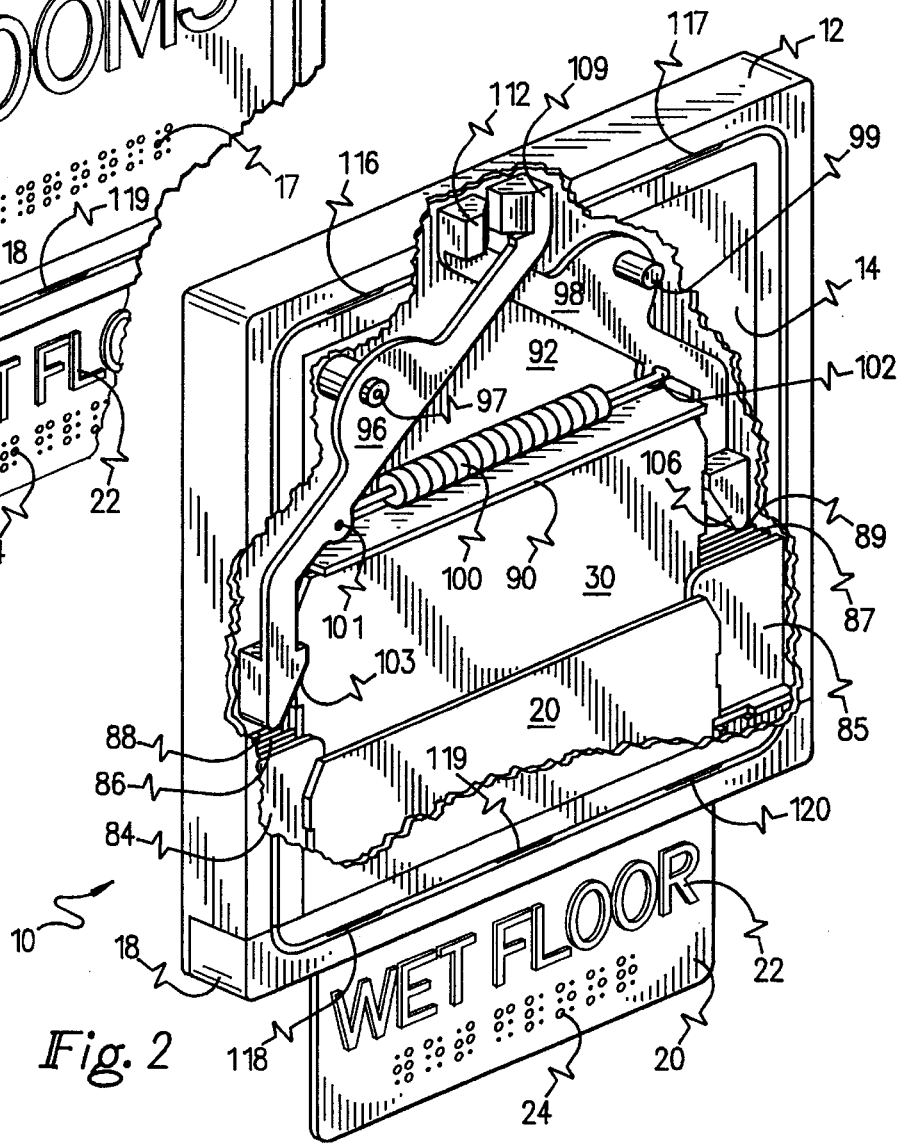
FIG. 2 is a partially cut-away perspective view illustrating the multi-message sign of the present invention.
Figure 3:
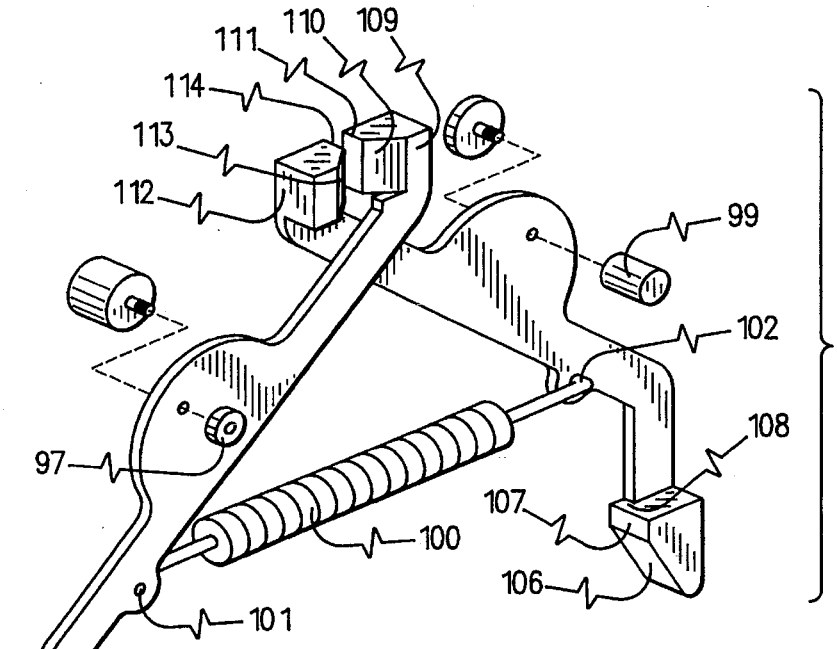
FIG. 3 is an exploded perspective detail view illustrating the secondary sign retaining mechanism of the multi-message sign of the present invention.

With reference to FIG. 2, a plurality of fixed pairs of aligned dividers 84, 85; 86, 87; and 88, 89 mounted internally at opposite sides of the frame 12 form guide slots dimensioned for the reception of the secondary signs 20, 30, and 40, which slots function to guide the secondary signs for limited reciprocal vertical movement through the open central bottom portion of the cover 18. A barrier or partition 90 secured to an interior surface of a back wall 92 of the frame 12 limits upward movement of the secondary signs by functioning as an abutment stop for engagement with the top edges 83 of the secondary signs.

Figure 5:
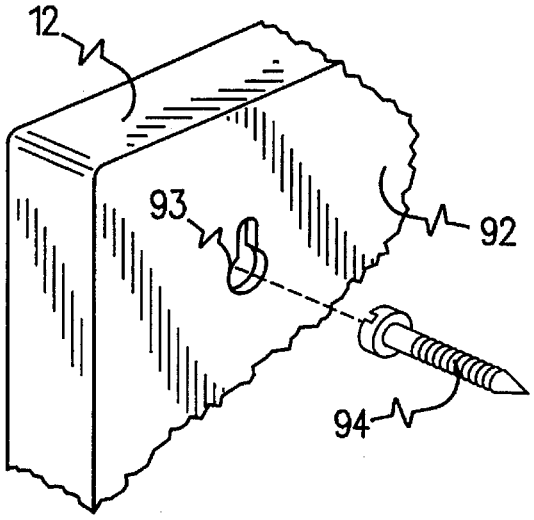
FIG. 5 is a perspective detail view illustrating an example manner of mounting the multi-message sign of the present invention.

The sign 10 may be mounted to a door, wall, or other surface by a variety of different fasteners, such as double sided tape, or by engaging the heads of screws 94 with keyhole slots 93 formed through the back wall 92 of the sign 10, as shown in FIG. 5.

Figure 4:
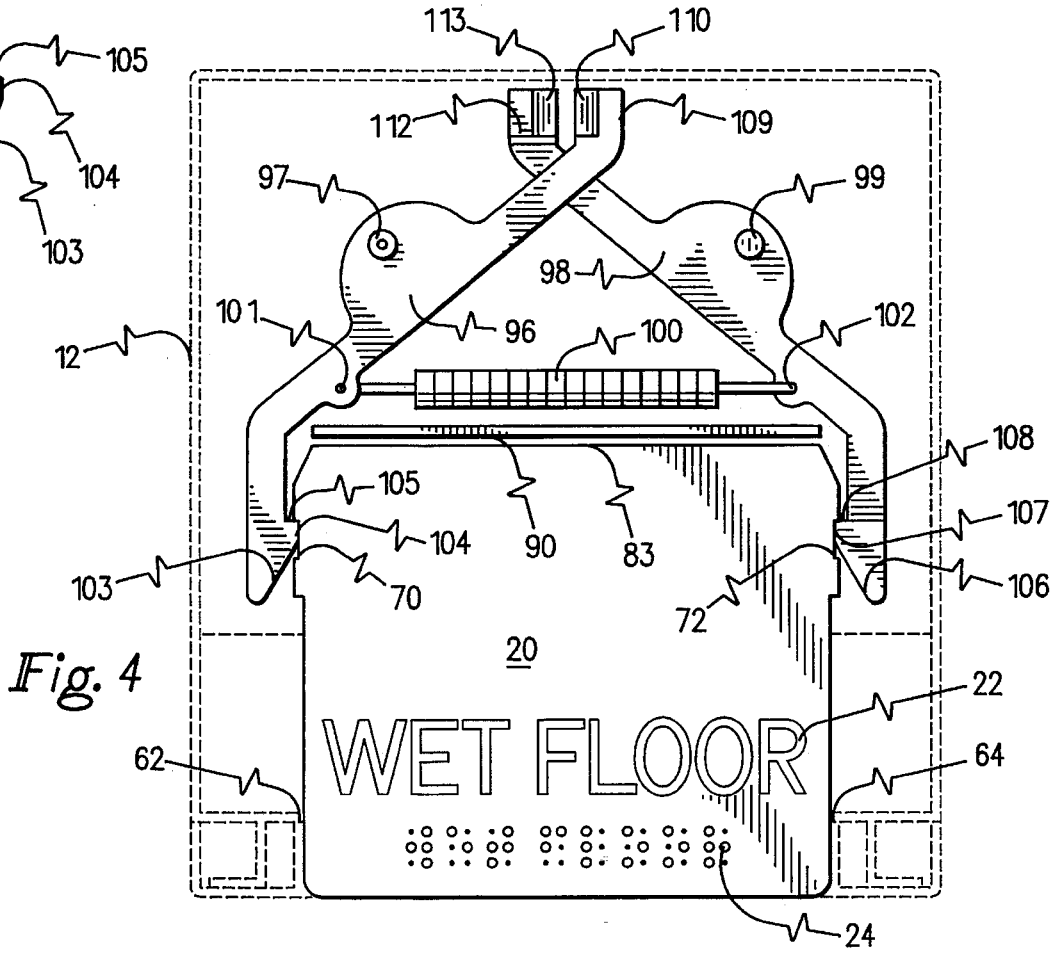
FIG. 4 is a diagrammatic front elevational view illustrating the secondary sign retaining mechanism of the multi-message sign of the present invention.

The sign 10 includes a retaining mechanism for retaining a plurality of the secondary signs in a raised, concealed position within the frame 12, and for selectively allowing the secondary signs to drop for display purposes. In the illustrated preferred embodiment, with reference to FIGS. 2, 3, 4, 7, and 10 the retaining mechanism includes a pair of pivotal latch arms 96 and 98 pivotally secured to the back wall 92 by respective pivot screws 97 and 99. Opposite straight end portions of a coil spring 100 engage apertures 101 and 102 in the arms 96 and 98, biasing inclined ramp latch end portions 103 and 106 together, into a latched position with the secondary signs 20, 30, and 40, as shown in FIG. 4. In this position, straight wall portions 104 and 107 of distal ends of the arms 96 and 98 engage the notches 70 and 72 in the secondary signs, retaining them in the illustrated raised concealed position. Ledge regions 105 and 108 on the pivotal arms 96 and 98 function as stop surfaces preventing the secondary signs from falling downwardly.

Figure 6:
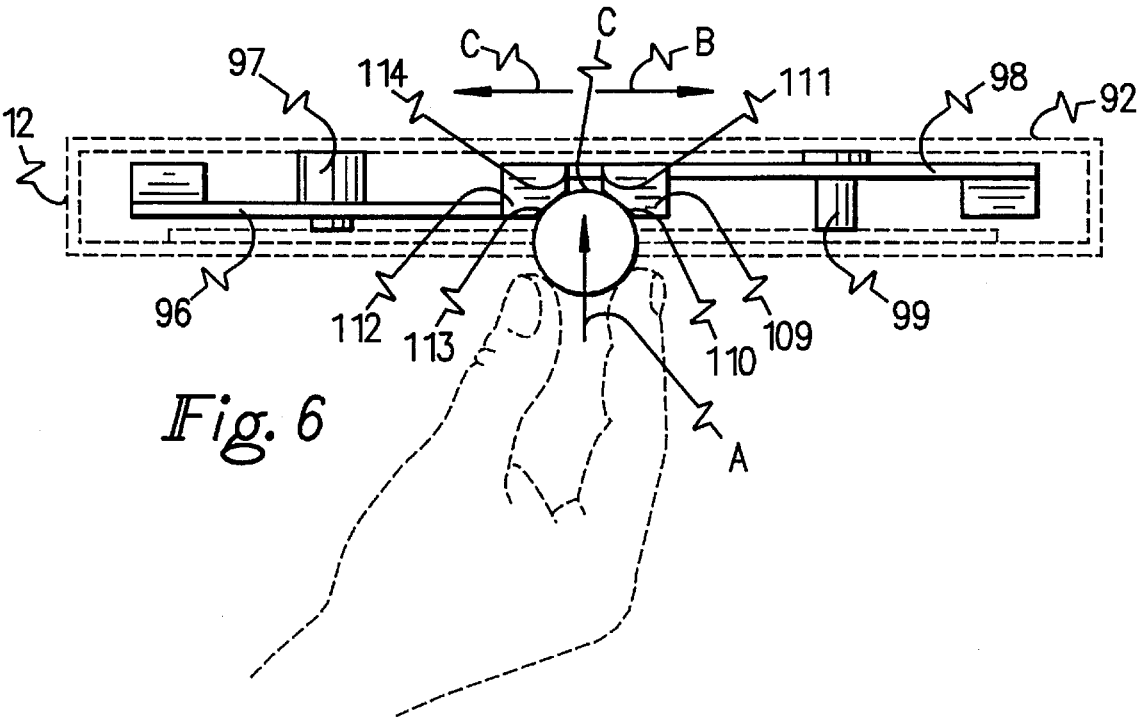
FIG. 6 is a diagrammatic top plan view illustrating the manner of operating the secondary sign retaining mechanism of the multi-message sign of the present invention.

In order to release the pivotal arms 96 and 98 from the latched position shown in FIG. 4, an individual inserts a coin C, such as a penny, dime, nickel, or quarter, edgewise between upper proximal ends 109 and 112 of the pivotal arms 96 and 98, in the manner shown in FIG. 6. By pushing the coin C in the direction of arrow A, an individual causes the coin to contact inclined cam surfaces 110 and 113, effecting movement of the upper ends 109 and 112 apart, against the bias of the spring 100, as indicated by arrows B and C. Continued insertion of the coin C displaces the ledge portions 105 and 108 and straight wall portions 104 and 107 of the arms 96 and 98 from the secondary sign notches 70 and 72, allowing the secondary sign to fall through the central open bottom portion of the cover 18 into the display position shown in FIG. 7.

The bottom end portions of the latch arms 96 and 98 have a thickness sufficient to span the notches of a plurality of the secondary signs disposed in overlying relation, such that the single retaining mechanism is capable of holding all of the secondary signs in the raised concealed position. Since insertion of a coin as shown in FIG. 6 disengages the latch arms 96 and 98 from all of the secondary signs, they will all simultaneously drop. In order to select the desired message,. the user merely pushes the undesired secondary signs upwardly such that the corner facets 80 and 82 engage the pivot arm ramp surfaces 103 and 106, camming the arms apart to allow continued upward movement of the undesired signs. Ultimately, the spring 100 causes the arms to snap into engagement with the notches 70 and 72, thus again locking the undesired secondary signs in the concealed position.

The sign of the present invention includes tamper resistant features. First, the cover latch members 58 are hidden when the cover 18 is in place, as can be appreciated from FIGS. 2, 8, and 9. Second, the retaining mechanism for the secondary signs is concealed. With reference to FIGS. 1 and 2, the frame 12 includes a plurality of apparently identical slots 115, 116, 117, 118, 119, and 120. Insertion of a coin into only slot 115 will function to release the retaining mechanism to allow the secondary signs to drop into view. Slots 116, 117, 118, 119, and 120 are all fake or decoy slots intended to give the sign a symmetrical appearance which disguises the manner of operation.

The various components of the sign 10 may be molded from a plastic material, or formed by conventional fabrication techniques from a wide variety of other materials. The sign 10 may include internal lamps and employ translucent and/or transparent materials to provide an illuminated sign. Also the sign may comprise flash lights and/or sound making devices that can be activated to call attention to the message(s) being displayed and provide additional warning when unsafe conditions are present. While the sign 10 has been illustrated in connection with three secondary signs, a greater or fewer number may be employed, limited in number only by the desired maximum thickness of the sign. Furthermore, the primary and secondary signs may be replaced by other primary and secondary signs when needed or desired.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A sign, comprising:

a frame;

at least one sign mounted for sliding movement in said frame between a first position in which indicia on said sign is at least partially concealed and a second position in which indicia on said sign is exposed; and a retaining mechanism for selectively retaining said sign in said first position, said retaining mechanism concealed to inhibit tampering and including an access aperture through which an implement must be inserted to release said retaining mechanism.

2. The sign apparatus of claim 1, wherein said sign falls to said second position by virtue of gravity upon release of said retaining mechanism.

3. The sign apparatus of claim 1, wherein said retaining mechanism comprises at least one pivotal latch arm.

4. The sign apparatus of claim 3, wherein said sign includes a notch dimensioned for engagement with said latch arm in said first position.

5. The sign apparatus of claim 1, wherein said access aperture is dimensioned for insertion of a coin to release said retaining mechanism.

6. The sign apparatus of claim 1, wherein said frame includes a region for displaying at least one primary message and wherein said sign includes a secondary message for display on selected occasions.

7. A sign comprising:

frame means;

a plurality of signs;

means mounting said plurality of signs for sliding movement in said frame means between a first position in which indicia on at least one of said signs is at least partially concealed and a second position in which indicia on at least one of said signs is exposed;

retaining means for selectively retaining said signs in said first position;

means for concealing said retaining means to inhibit tampering; and means for selectively releasing said retaining means upon insertion of an implement.

8. A sign apparatus comprising:

a frame;

a primary sign mounted for substantially constant display on a front region of said frame;

at least one secondary sign mounted for sliding movement in said frame between a first position in which indicia on said secondary sign is at least partially concealed and a second position in which indicia on said secondary sign is exposed; and a retaining mechanism for selectively retaining said secondary sign in said first position, said retaining mechanism including at least one pivotal arm dimensioned and disposed for engagement with at least one notch in said secondary sign in said first position.

9. The sign apparatus of claim 8 wherein said frame includes an open bottom region through which said secondary sign extends in said second position.

10. The sign apparatus of claim 8, wherein said pivotal arm includes an inclined ramp portion and said secondary sign includes an inclined corner facet such that upward movement of said secondary sign moves said pivotal arm to allow passage of said secondary sign.

11. The sign apparatus of claim 8, further comprising a spring biasing said pivotal arm into engagement with said notch.

12. A sign apparatus comprising:

a frame;

a primary sign mounted for substantially constant display on a front region of said frame;

a plurality of secondary signs mounted for sliding movement in said frame between a first position in which indicia on said secondary signs is at least partially concealed and a second position in which indicia on said secondary signs is exposed; and a retaining mechanism for selectively retaining said secondary signs in said first position, said retaining mechanism including a pair of pivotal arms, each of said pivotal arms including a distal end portion engageable in notches provided in said secondary signs.

13. The sign apparatus of claim 12, wherein proximal ends of said pivotal arms include cam surfaces adapted for engagement with an implement for moving said distal end portions of said pivotal arms out of engagement with said notches.

14. The sign apparatus of claim 12, further comprising a spring biasing said pivotal arms into engagement with said notches.

15. The sign apparatus of claim 12, wherein said distal end portions of said pivotal arms include inclined ramp surfaces disposed for contact with inclined corner facets on said secondary signs such that upward movement of said secondary signs moves said pivotal arms to allow passage of said secondary signs.

16. The sign apparatus of claim 12, further comprising a selectively detachable cover on a bottom portion of said frame to facilitate removal and replacement of said secondary signs.

17. The sign apparatus of claim 16, wherein said cover includes hidden latch members to deter tampering.

18. The sign apparatus of claim 12, wherein said retaining mechanism is hidden to deter tampering.

19. The sign apparatus of claim 12, further comprising at least one access aperture to allow manual release of said retaining mechanism.

20. The sign apparatus of claim 19, further comprising at least one decoy aperture to disguise said access aperture and deter tampering.

21. A sign apparatus, comprising:

a frame;

at least one sign mounted for sliding movement in said frame between a first position in which indicia on said sign is at least partially concealed and a second position in which indicia on said sign is exposed;

a retaining mechanism for selectively retaining said sign in said first position, said retaining mechanism including at least one pivotal latch arm; and said sign including a notch dimensioned for engagement with said latch arm in said first position.

22. The sign apparatus of claim 21, wherein said sign falls to said second position by virtue of gravity upon release of said retaining mechanism.

23. The sign apparatus of claim 21, wherein said frame includes a region for substantially permanently displaying at least one primary message and wherein said sign includes a secondary message for display on selected occasions.

24. The sign apparatus of claim 21, wherein said retaining mechanism is concealed to inhibit tampering.

25. The sign apparatus of claim 21, wherein said frame includes an open bottom region through which said sign extends in said second position.

26. The sign apparatus of claim 21, wherein said pivotal arm includes an inclined ramp portion and said sign includes an inclined corner facet such that upward movement of said secondary sign moves said pivotal arm to allow passage of said sign.

27. The sign apparatus of claim 21, further comprising a spring biasing said pivotal arm into engagement with said notch.

28. The sign apparatus of claim 21, wherein said retaining mechanism is hidden within said frame to deter tampering.

29. The sign apparatus of claim 21, further comprising at least one access aperture to allow manual release of said retaining mechanism.

30. The sign apparatus of claim 29, further comprising at least one decoy aperture to disguise said access aperture and deter tampering.

* * * * *